US007845079B2

(12) United States Patent
McGuire

(10) Patent No.: US 7,845,079 B2
(45) Date of Patent: Dec. 7, 2010

(54) SHAVING FOIL

(75) Inventor: Kenneth Stephen McGuire, Cincinnati, OH (US)

(73) Assignee: The Gillette Company, Boston, MA (US)

( * ) Notice: Subject to any disclaimer, the term of this patent is extended or adjusted under 35 U.S.C. 154(b) by 586 days.

(21) Appl. No.: 11/491,423

(22) Filed: Jul. 21, 2006

(65) Prior Publication Data

US 2007/0022608 A1 Feb. 1, 2007

Related U.S. Application Data

(63) Continuation-in-part of application No. 11/193,588, filed on Jul. 29, 2005, now abandoned.

(51) Int. Cl.
*B26B 19/00* (2006.01)

(52) U.S. Cl. ..... 30/43.92; 30/43

(58) Field of Classification Search ..... 30/43, 30/43.92, 346.51

See application file for complete search history.

(56) References Cited

U.S. PATENT DOCUMENTS

| | | | | | |
|---|---|---|---|---|---|
| 2,174,039 | A | * | 9/1939 | Muros | 30/346.51 |
| 3,382,580 | A | * | 5/1968 | Rinck et al. | 30/346.51 |
| 3,696,508 | A | * | 10/1972 | Messinger | 30/43 |
| 3,949,469 | A | | 4/1976 | Brauss | |
| 3,967,373 | A | * | 7/1976 | Sakai et al. | 30/43.92 |
| 4,009,518 | A | | 3/1977 | Locke et al. | |
| 4,035,914 | A | * | 7/1977 | Blume et al. | 30/346.51 |
| 4,105,493 | A | | 8/1978 | Chauvy | |
| 4,134,202 | A | | 1/1979 | Buchholz | |
| 4,138,811 | A | | 2/1979 | Chauvy | |
| 4,184,250 | A | | 1/1980 | Meijer | |
| 4,621,423 | A | | 11/1986 | Schemmann et al. | |
| D307,645 | S | | 5/1990 | Mahlich et al. | |
| 4,985,999 | A | | 1/1991 | Iwasaki et al. | |
| 5,185,926 | A | | 2/1993 | Locke | |
| 5,185,933 | A | * | 2/1993 | Messinger | 30/346.51 |
| D338,984 | S | | 8/1993 | Locke | |

(Continued)

FOREIGN PATENT DOCUMENTS

WO WO 03/013802 A2 2/2003

(Continued)

OTHER PUBLICATIONS

U.S. Appl. No. 11/193,588, filed Jul. 29, 2005, McGuire.

(Continued)

*Primary Examiner*—Jason Daniel Prone
*Assistant Examiner*—Jennifer Swinney
(74) *Attorney, Agent, or Firm*—John M. Lipchitz; Kevin C. Johnson; Steven W. Miller

(57) ABSTRACT

A shaving foil for a shaving system comprises a foil support section and a hair-receiving section. The foil support section is provided for support of the foil over a cutting member of the shaving system. The hair-receiving section of the foil includes a plurality of hair-entrance apertures that define at least one amorphous arrangement of apertures and a plurality of foil surface members that form a network of surface area adjacent to the plurality of hair-entrance apertures.

21 Claims, 10 Drawing Sheets

U.S. PATENT DOCUMENTS

| | | | | |
|---|---|---|---|---|
| 5,377,414 | A | 1/1995 | Buzzi et al. | |
| D362,739 | S | 9/1995 | Avila | |
| D371,635 | S | 7/1996 | Ullmann | |
| 5,553,383 | A | 9/1996 | Wetzel | |
| 5,735,756 | A * | 4/1998 | Stiefel et al. | 473/382 |
| 5,750,956 | A | 5/1998 | Barnes et al. | |
| 5,965,235 | A | 10/1999 | McGuire et al. | |
| 6,254,965 | B1 | 7/2001 | McGuire et al. | |
| 6,409,615 | B1 * | 6/2002 | McGuire et al. | 473/383 |
| 6,421,052 | B1 * | 7/2002 | McGuire | 345/441 |
| 6,595,938 | B1 * | 7/2003 | Delmore et al. | 602/8 |
| 6,695,720 | B2 * | 2/2004 | Sullivan | 473/378 |
| 7,065,879 | B2 * | 6/2006 | Bader et al. | 30/43.92 |
| 2001/0027609 | A1 | 10/2001 | Packham et al. | |
| 2002/0092173 | A1 | 7/2002 | Zuidervaart et al. | |
| 2003/0070304 | A1 | 4/2003 | Curello | |
| 2004/0083865 | A1 | 5/2004 | Stevens | |
| 2004/0168321 | A1 | 9/2004 | Bader et al. | |

FOREIGN PATENT DOCUMENTS

| | | | |
|---|---|---|---|
| WO | WO 03/013802 | A3 | 5/2004 |

OTHER PUBLICATIONS

Braun Activator Shaver 8595; www.pickeringappliance.com/product_info.php?cPath=2_20&products_id=1162; Jan. 15, 2005.

Activator; www.braun.com/global/products/shavinggrooming/dryshaving/dryshaving/activator.html; Jan. 15, 2005.

Glassner, Andrew; Penrose Tiling; Andrew Glassner's Notebook; IEEE Computer Graphics and Applications; Jul./Aug. 1998; pp. 78-86.

Rangel-Mondragon, J. and Abas, S.J.; Computer Generation of Penrose Tilings; Computer Graphics Forum; vol. 7, Issue 1; 1988; pp. 29-37; North-Holland.

Venables, W.N. and Ripley, B.D.; 14.3 Point process analysis; Modern Applied Statistics with S-PLUS Third Edition; pp. 444-447; Springer.

Broughton, J. and Davies, G.A.; "Porous cellular ceramic membranes: a stochastic model to describe the structure of an anodic oxide membrane"; Journal of Membrane Science 106 (1995); pp. 89-101.

Zhu, H.X., et al.; "The geometrical properties of irregular two-dimensional Voronoi tessellations"; Philosophical Magazine A, 2001, vol. 81, No. 12, pp. 2765-2783.

* cited by examiner

SHAVING FOIL

FIELD OF THE INVENTION

This application is a continuation-in-part of U.S. application Ser. No. 11/193,588, filed Jul. 29, 2005 now abandoned.

FIELD OF THE INVENTION

The present invention relates in general to foils for shaving systems and in particular to foils having an amorphous arrangement of hair-entrance apertures. This invention further relates to methods of producing shaving system foils having an amorphous arrangement of hair-entrance apertures.

BACKGROUND OF THE INVENTION

The cutting head of an electric shaving system conventionally comprises a shear foil and an inner, movable cutter. The foil is a thin, flexible member that has a plurality of perforations or apertures therethrough for receiving hairs and stubble to be shaved. The corresponding cutter is positioned in contact with a rear surface of the foil and typically comprises a plurality of separate blades, but may also include a cutting foil or other suitable cutting device. Regardless of the specific configuration, the cutter vibrates or otherwise reciprocates back and forth over the apertures in the foil.

During a shaving operation, the foil is brought into intimate contact with the skin. As the shaving system is moved about an area to be shaved, hair and stubble pass through the apertures in the foil and are trimmed by the movable cutter, which repeatedly crosses the apertures in the foil. As such, the closeness, comfort and quality of the resulting shave are affected, at least in part, by the design of the foil.

In particular, the size, shape and orientation of the apertures in the foil affect the performance of the shaving operation. Thus, previous foils have been provided with repeating patterns of circular, rectangular, hexagonal and other geometric shaped apertures in an attempt to find a pattern that will provide a close and comfortable shave. However, hairs tend to grow in distinctly different directions. Moreover, hairs tend to exhibit differences in size.

SUMMARY OF THE INVENTION

An embodiment of the present invention provides a shaving foil for a shaving system comprising a foil support section and a hair-receiving section. The foil support section is provided for support of the foil over a cutting member of the shaving system. The hair-receiving section of the foil includes a plurality of hair-entrance apertures that define at least one amorphous arrangement of apertures and a plurality of foil surface members that form a network of surface area adjacent to the plurality of hair-entrance apertures.

Generally, the amorphous arrangement of apertures exhibits no readily discernable or perceptible pattern to the organization or regularity of the hair-entrance apertures within the bounds of one or more predetermined constraints, where the predetermined constraints may include limitations such as those imposed by the physical dimensions of the hair-receiving section of the foil, the desired number of hair-entrance apertures within the hair-receiving section of the foil, the desired minimum spacing between adjacent hair-entrance apertures, the minimum and maximum desired size of a given hair-entrance aperture and other considerations characteristic of performing the function of shaving.

According to another embodiment of the present invention, a shaving system comprises a housing and a cutting head. The cutting head is positioned at a first end of the housing and includes a cutting member extending from the housing, a foil frame mated with the housing and a foil supported by the foil frame so as to be oriented generally over the cutting member. The foil includes a hair-receiving section comprised of a plurality of foil surface members and a plurality of hair-entrance apertures that define at least one amorphous arrangement of apertures, wherein each hair-entrance aperture is at least partially surrounded by associated foil surface members that are interconnected in a network of surface area.

According to another embodiment of the present invention, a method of manufacturing a foil for a shaving system comprises providing a foil, defining a hair-receiving section of the foil and forming a plurality of apertures in the hair-receiving section of the foil to define at least one amorphous arrangement of apertures, wherein each hair-entrance aperture is at least partially surrounded by associated foil surface members that are interconnected in a network of surface area.

BRIEF DESCRIPTION OF THE DRAWINGS

The following description of the preferred embodiments of the present invention can be best understood when read in conjunction with the following drawings, where like structure is indicated with like reference numerals, and in which.

DETAILED DESCRIPTION OF THE INVENTION

In the following description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
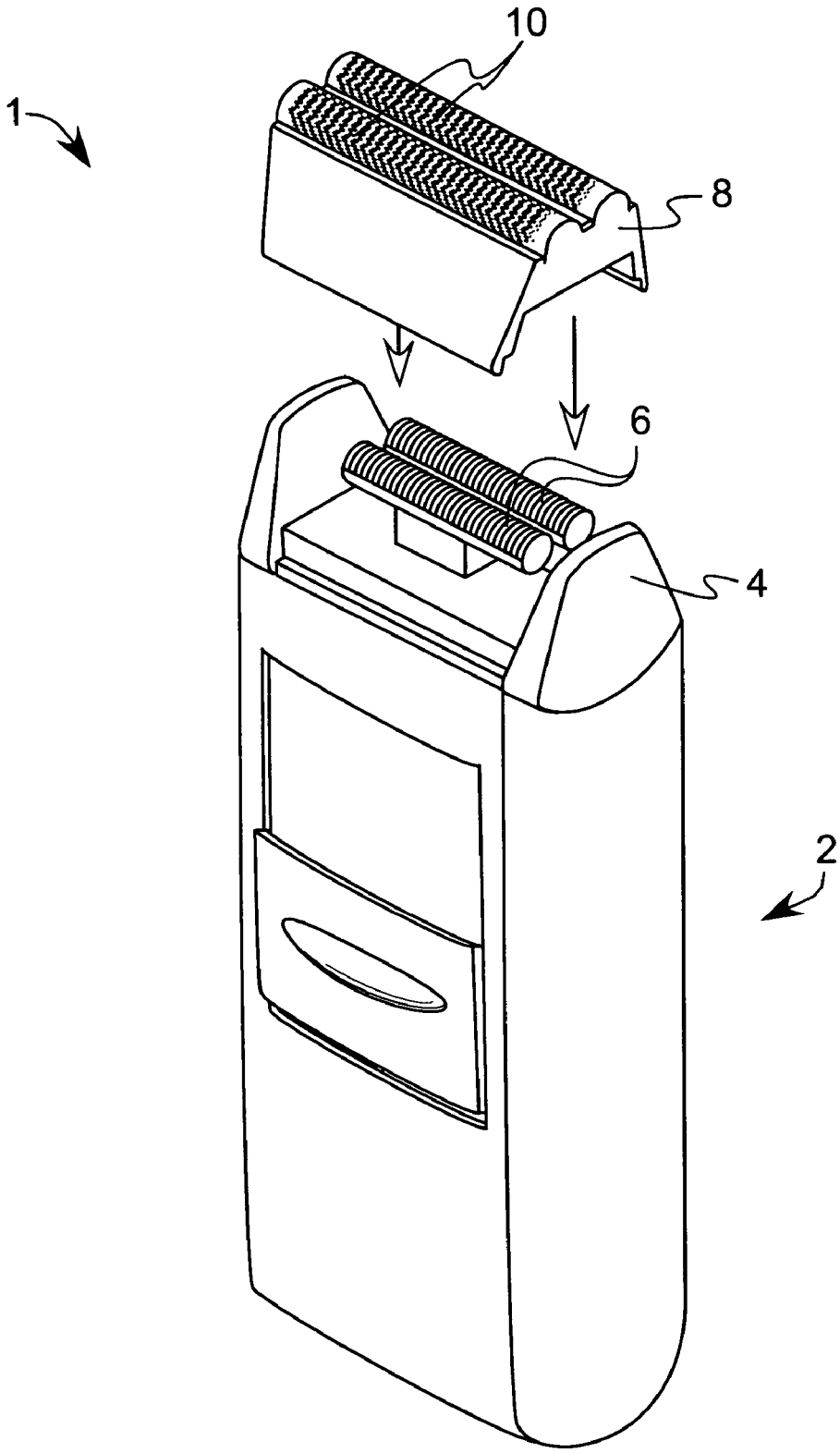
FIG. 1 is an illustration of an exemplary shaving system.

Referring now to the drawings, and particularly to FIG. 1, a shaving system 1 comprises a housing 2 and a cutting head 4. The cutting head 4 is positioned at one end of the housing 2 and includes one or more cutting members 6 that extend generally from the housing 2, a detachable foil frame 8 that mates with the housing and one or more shaving foils 10 that are supported by the foil frame 8 so as to be oriented generally over the cutting member 6 when the foil frame 8 is attached to the housing 2. The housing 2 also supports switches, motors, electronic circuitry and/or other components for selectively energizing the cutting members 6 of the cutting head 4. Although the cutting members 6 are illustrated for purposes of clarity as a plurality of axially aligned, generally circular cutting disks, other cutting configurations including independent cutting blades and cutting foils may be used.

Figure 2:
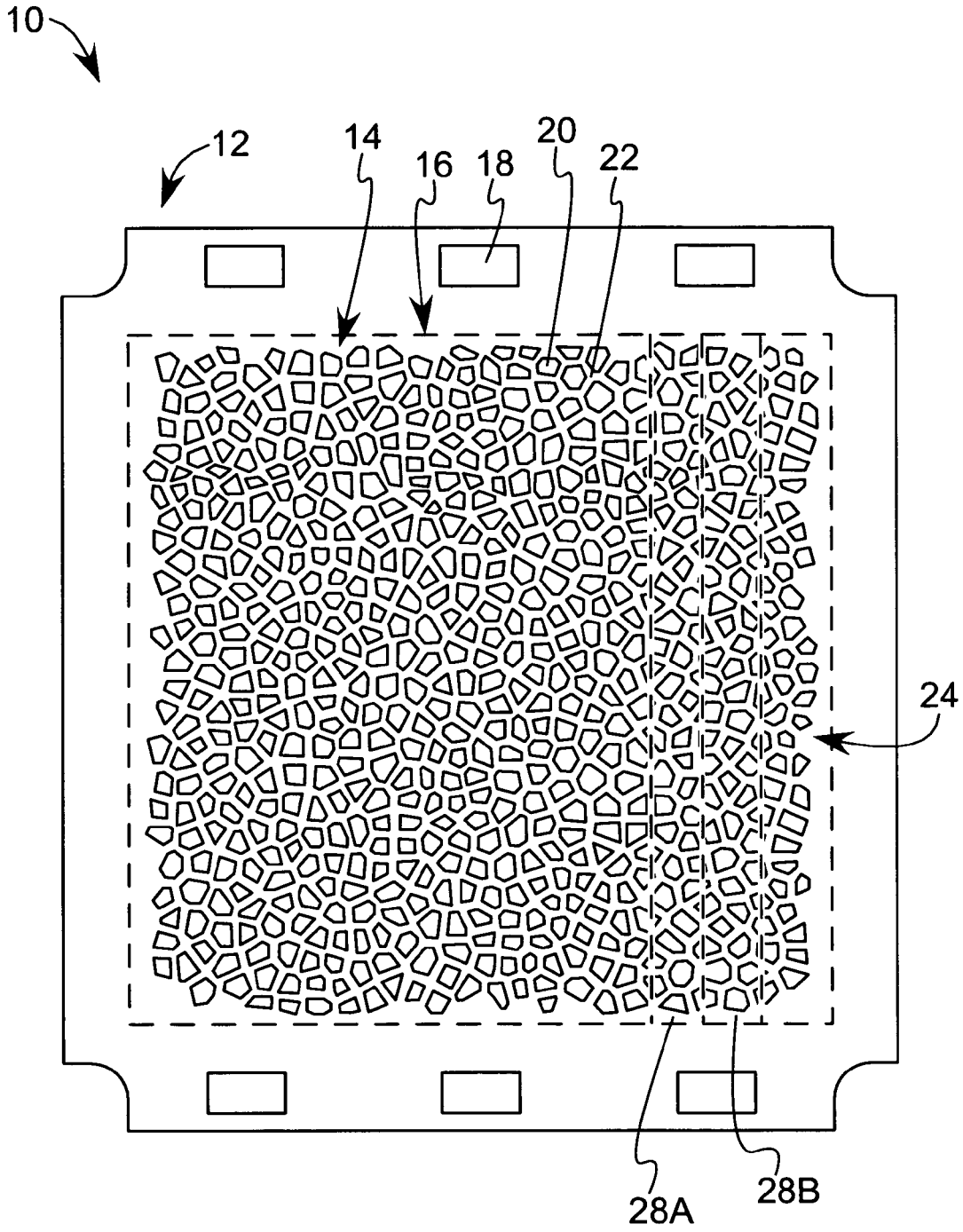
FIG. 2 is an illustration of an exemplary foil according to an embodiment of the present invention.

Referring to FIG. 2, the shaving foil, which is indicated generally by the reference numeral 10, comprises a foil support section 12 and a hair-receiving section 14. The foil support section 12 defines a securement arrangement that may be oriented, for example, adjacent to a perimeter 16 of the hair-receiving section 14. The illustrated foil support section 12 includes mounting features 18, such as holes, for attaching or otherwise mounting the foil 10 to the corresponding shaving system 1, e.g., by attaching the foil 10 to the foil frame 8 on the shaving head 4. The foil support section 12 may also be defined by the perimeter 16 or other portion of the hair-receiving section 14 of the foil 10. Still further, other arrangements may alternatively be used to define the foil support section 12 including direct or indirect integration of the foil 10 with regard to the foil frame 8.

The configuration of the shaving head 4 may vary considerably depending upon the particular shaving system 1, thus the general size and shape of the particular foil 10 will correspond to the particular shaving system 1. For example, as shown in FIG. 1, the shaving foil 10 conforms generally to the shape of the outer portion of the two axially extending cutting members 6 to form a generally arcuate, hair receiving sections 14. The arcuate hair receiving sections 14 may be formed from a single foil 10, or multiple foils 10 may be used, one foil 10 associated with each cutting member 6.

Figure 3:
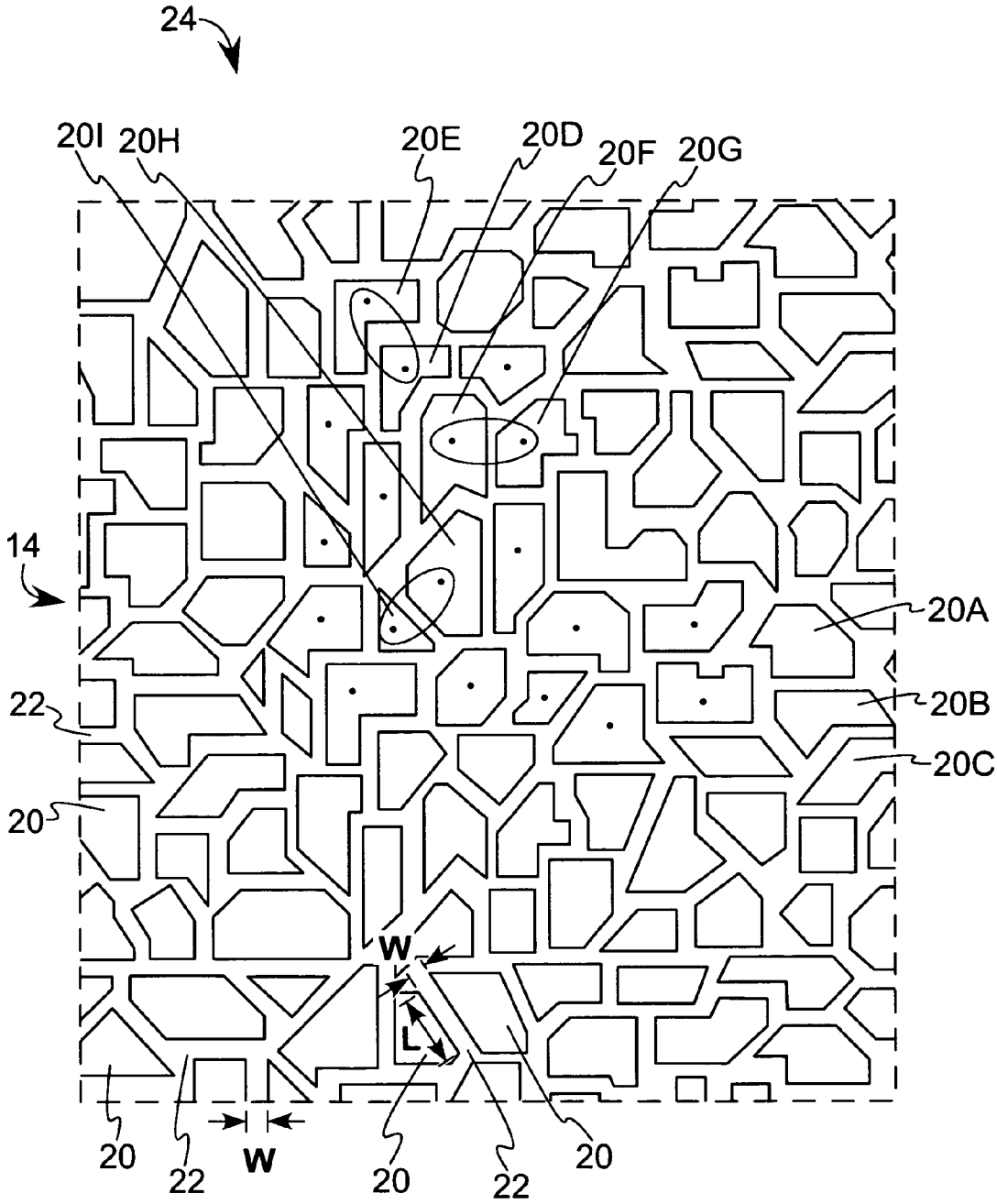
FIG. 3 is a partial view of an exemplary hair-receiving section of a foil according to an embodiment of the present invention.

The hair-receiving section 14 comprises a plurality of hair-entrance apertures 20 and foil surface members 22. The plurality of hair-entrance apertures 20 define at least one amorphous arrangement of apertures and the plurality of foil surface members 22 form a network of surface area adjacent to the plurality of hair-entrance apertures 20. As illustrated in the exemplary hair receiving section 14, the foil surface members 22 are interconnected and surround each hair-entrance aperture 20 to form a continuous network of foil surface area about and/or within the hair-receiving section 14 in a manner that forms an amorphous arrangement of apertures 24. As illustrated in FIG. 3, a foil surface width, which is designated by the dimension marking W, represents the width of a foil surface member 22 and corresponds to a distance between a point on one edge of a hair entrance aperture 20 and a proximal point on the edge of an adjacent hair-entrance aperture 20.

As illustrated, the foil surface width W is configured to remain substantially uniform across a length L, which is a distance that corresponding edges of adjacent hair-entrance apertures remain substantially parallel to one another. However, the edges of adjacent hair entrance apertures 20 need not be parallel or substantially parallel and likewise, a chord between two points of adjacent hair entrance apertures 20 may not be perpendicular to either aperture edge. Moreover, the Width W may be substantially uniform for all foil surface members 22, or alternatively, the width W may vary among the various foil surface members 22. Still further, the foil surface members 22 may exhibit other arrangements of non-uniform width characteristics.

Characterization of an Amorphous Arrangement of Apertures

Generally, the amorphous arrangement of apertures 24 exhibits no readily discernable or perceptible organization or regularity of the hair-entrance apertures 20 within the bounds of one or more predetermined constraints, where the predetermined constraints may include limitations such as those imposed by the physical dimensions of the hair-receiving section 14 of the foil 10, the desired number of hair-entrance apertures 20 within the hair-receiving section 14 of the foil 10, the desired minimum spacing between adjacent hair-entrance apertures 20, e.g., the width W of a corresponding foil surface member 22, minimum and maximum desired size of a given hair-entrance aperture 20, which will likely correspond to the minimum and maximum anticipated hair size, and other considerations characteristic of performing the function of shaving.

An amorphous arrangement of apertures 24 generally includes at least one feature that is random, pseudo-random, or apparently random, as will be described in greater detail herein. For example, an aperture size and/or shape feature may be implemented such that there is no readily discernable or perceptible pattern to the orientation, size and/or shape of the constituent hair-entrance apertures 20 within the amorphous arrangement of apertures 24, again within the bounds of one or more of the predetermined constraints.

The hair-entrance apertures 20 are referred to generally as polygonal shaped apertures, or simply polygons, which may comprise geometric shapes having a finite number of straight sides, e.g., triangles, rectangles, parallelograms, etc. Also, a polygon, as used herein, may have an infinite number of straight sides, thus including within the general description of polygons, curvilinear and amoeba shapes and combinations thereof, including for example, circles, semi-circles, ellipsoids, wedges, truncated wedges, slots, wave and serpentine shaped apertures, etc.

In the amorphous arrangement illustrated in FIG. 3, the orientation and geometry of a first hair-entrance aperture 20A with regard to a neighboring hair-entrance aperture 20B appears to bear no predictable relationship to that of the next succeeding hair-entrance aperture 20C. In one exemplary configuration, an amorphous arrangement of apertures 24 is characterized by a random center-to-center spacing feature in which aperture center-to-center spacing appears random or at least non-uniform within a designer specified range of values.

Here, the center of a hair-entrance aperture 20 may be defined in any reasonable manner and may include a point located either within or outside the bounds of a given hair-entrance aperture 20. The particular choice of a defined center will likely depend upon whether the hair-entrance apertures 20 include odd or complex shapes such as amoebas, or curvilinear shapes such as slots or waves, or other non-simple geometric configurations. Some exemplary center points may include using a geometric center, center of mass, a point within an area that is approximately central within the aperture or some large region of the aperture or a principal or important point of concentration such as a nucleus of the aperture shape. The center may also comprise a point used in the generation of the aperture, such as a nucleation point center. The use of nucleation points as part of a process of generating the hair-entrance apertures 20 will be described in greater detail herein. However, there is a generally equal likelihood that the nearest aperture center to a given aperture center occurs at any given angular position within the plane of the foil 10 within reasonable tolerances and resolution.

As one example, FIG. 3 illustrates that the nearest aperture center to hair-entrance aperture 20D is aperture 20E, as indicated by a loop surrounding their respective centers. The nearest aperture center to hair-entrance aperture 20F is aperture 20G, as indicated by a loop surrounding their respective centers. Similarly, the nearest aperture center to hair-entrance aperture 20H is aperture 201, as indicated by a loop surrounding their respective centers. As illustrated, there appears to be no order or pattern to the orientation of a closest aperture center to any given hair-entrance aperture 20. The above three exemplary loops, by themselves, do not show that the total illustrated arrangement of apertures is amorphous, but rather illustrates one exemplary approach of how to determine if an arrangement of apertures is amorphous. As will be described in greater detail herein, the amorphous arrangement of apertures 24 may extend over the entire hair-receiving section 14 or only a portion thereof.

The size, shape and/or orientation features of the hair-entrance apertures 20 may be randomized, at least to a statistically significant degree, e.g., with or without constraints or other predetermined limitations. For example, the size range of the hair-entrance apertures 20 will likely depend upon the anticipated range of hair sizes that the shaving system 1 is designed to cut. The degree of randomness imposed in shape and/or orientation features of the hair-entrance apertures may also vary depending upon whether the amorphous arrangement of apertures 24 is manually generated or whether the amorphous arrangement of apertures 24 is generated by a computer. Other feature characteristics of the hair-entrance apertures 20 that may be randomized, at least to a statistically significant degree, includes the number of sides of the hair-entrance apertures 20, minimum or maximum realizable angle between adjacent edges of the hair-entrance apertures 20, and other shape affecting considerations.

Figure 4:
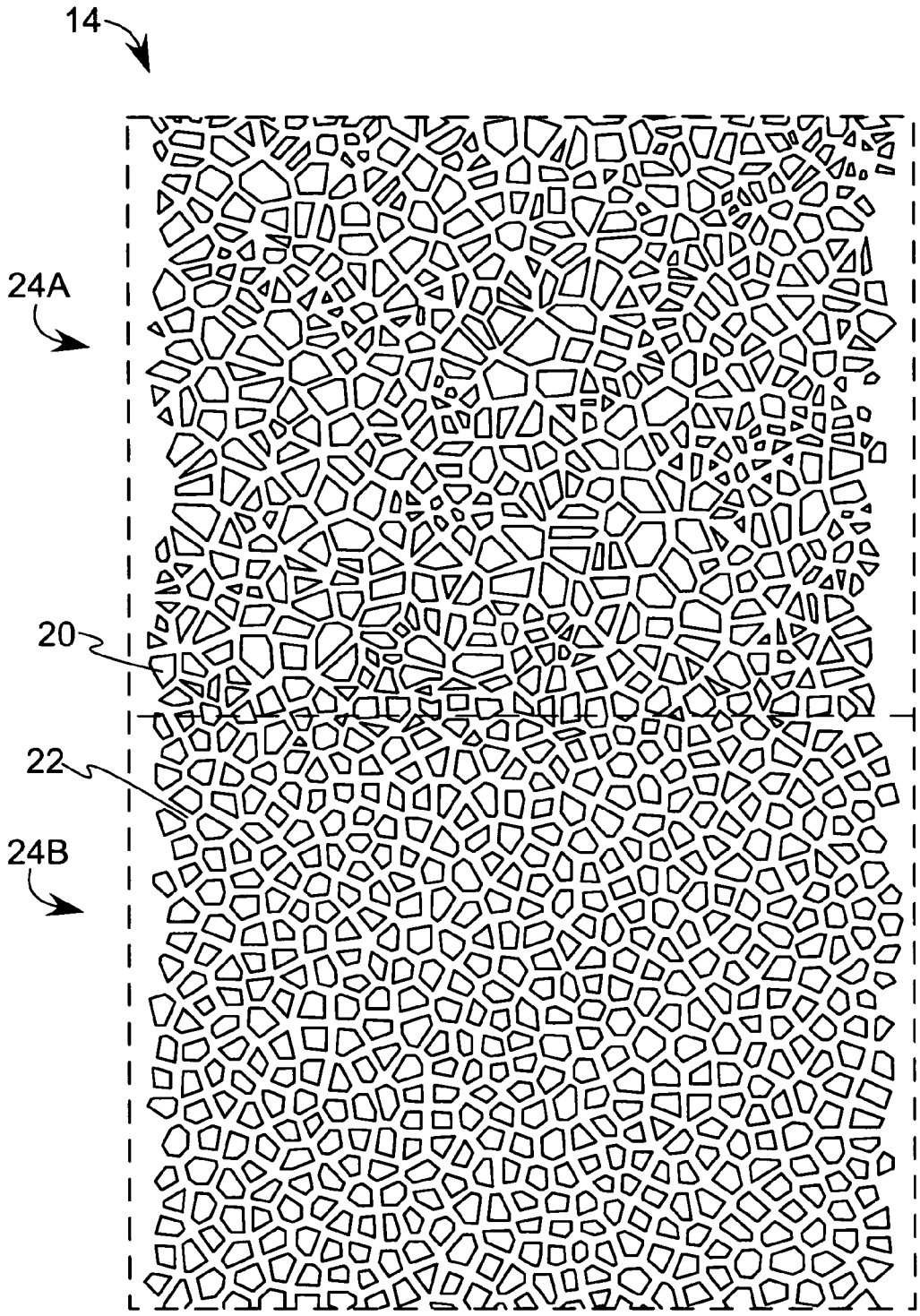
FIG. 4 is a partial view of an exemplary foil illustrating two adjacent amorphous arrangements.

There may be circumstances where it is undesirable or impractical to define a single amorphous arrangement of apertures 24 that is non-repeating across the entirety of the hair-receiving section 14 of the foil 10. Also, there may be circumstances where it is desirable to use amorphous arrangements designed with different sets of constraints within different areas of the hair-receiving section 14 of the foil 10. With reference to FIG. 4, a limited area of the hair-receiving section 14 of the foil 10 is shown in a partial view to illustrate a first amorphous arrangement of apertures 24A adjacent to a second amorphous arrangement of apertures 24B, where the first and second amorphous arrangement of apertures 24A, 24B were constructed using a different constraint that affects at least the variance in size of the corresponding hair-entrance apertures 20. As FIG. 4 illustrates, the size variance of the hair-entrance apertures 20 in the first amorphous arrangement 24A is greater than the variance in size of the hair-entrance apertures 20 in the second amorphous arrangement of apertures 24B.

As an example, it may be desirable to have hair-entrance apertures 20 of a greater randomness generally near a first region, e.g., the central portion, of the hair-receiving section 14 of the foil 10, and hair-entrance apertures 20 that have generally less deviation, e.g., in size, near a second region, e.g., the end regions of the hair-receiving section 14 of the foil 10. Still further, it may be desirable to conceptually delineate the hair-receiving section 14 of the foil 10 into multiple regions of amorphous arrangements even to the point of replication of the same amorphous arrangement in two or more such regions, e.g., by replicating the amorphous arrangement of apertures 24B on the opposite side of the amorphous arrangement of apertures 24A. Still further, in a shaving system requiring more than one foil 10, it may be desirable to have one or more foils 10 having hair-entrance apertures 20 defined by different amorphous characteristics or constraints.

Figure 5:
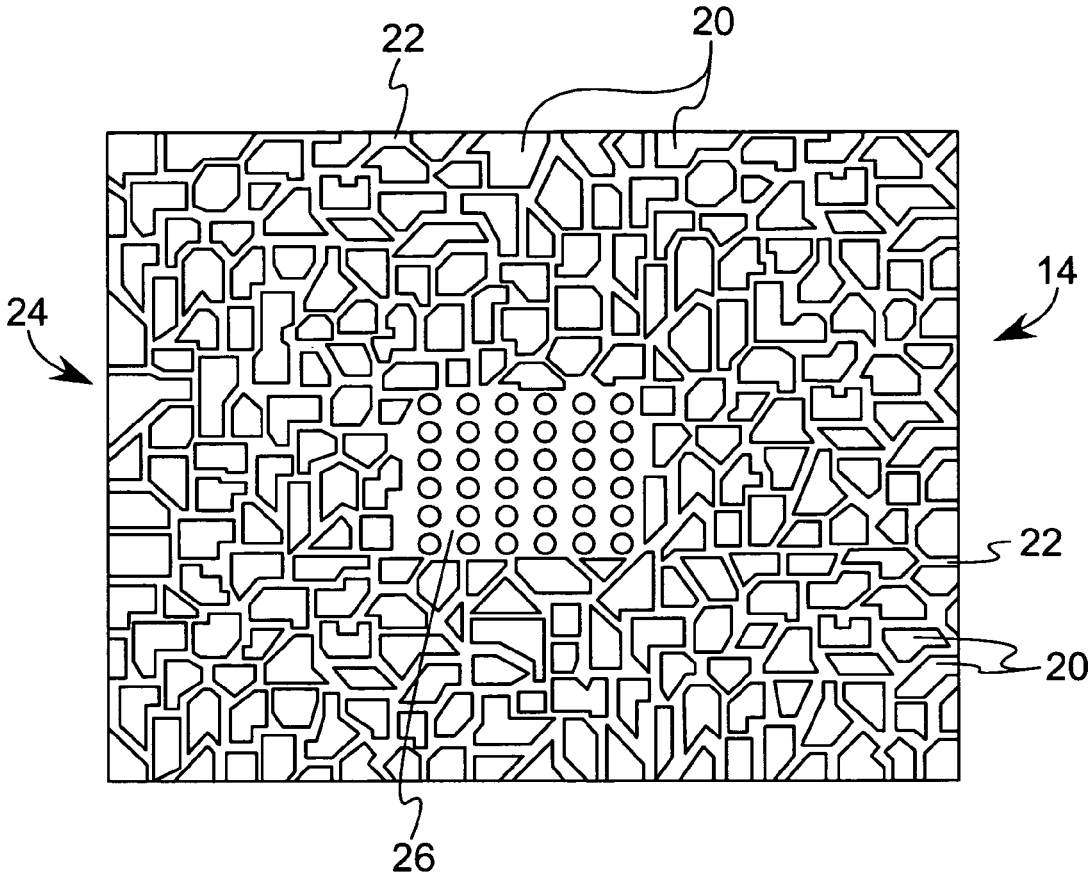
FIG. 5 is a partial view of an exemplary foil illustrating a combination of an amorphous arrangement and a non-amorphous pattern of apertures.

Further, it may be desirable to include within the hair-receiving section 14 of the foil 10, a combination of amorphous areas, and non-amorphous, patterned areas. Such may be required depending upon the capability of the manufacturing process or the needs of particular implementations of the present invention. For example, it may be desirable to limit or otherwise restrict the size, spacing or geometry of hair-entrance apertures 20 that align generally at a predetermined area of the hair-receiving section 14 of the foil 10, to a pattern of defined shape or geometry, e.g., where that defined shape has been found to provide a useful feature during shaving. Also, non-amorphous patterns of apertures may be provided to add distinctive markings to the foil 10. Additionally, an amorphous region may fully envelop or circumscribe one or more non-amorphous areas. With reference to FIG. 5, the amorphous arrangement of apertures 24 is illustrated as enclosing an exemplary repeating pattern of circular-shaped apertures 26.

The term "random" as applied to describing one or more feature characteristics of the amorphous arrangement of apertures 24 may in practice be truly random, pseudorandom or apparently random. For example, a mathematically generated (e.g., computer generated) random number may be used to define a parameter that characterizes the hair-entrance apertures 20 as will be described in greater detail herein. However, the sophistication of the algorithm implementing the random function will affect how random the generated numbers truly are. Also, an amorphous arrangement of apertures 24 may be implemented or designed manually. Such a manually implemented design may result in an amorphous arrangement of apertures over predetermined constraints, but may also result in a pattern that is not random in a strict sense, but is apparently random or pseudorandom.

However, in either case, the hair-entrance apertures 20 may be arranged such that in the aggregate, there is at least an appearance of randomness to the apertures, at either a localized or global perspective, e.g., in the sense of a highly disordered or vaguely defined arrangement of apertures across the amorphous region of the hair-receiving section 14 of the foil 10. For example, there may be more than one hair-entrance aperture 20 of a given size and/or shape within the amorphous arrangement of apertures 24. However, the pattern of hair-entrance apertures 20 is non-uniform such that it is unlikely that a reasonably sized grouping of adjacent hair-entrance apertures 20 within the corresponding amorphous arrangement of apertures 24 will be the same as any other like grouping of hair-entrance apertures 20.

The amorphous arrangement of apertures 24 may also be arranged so as to exhibit one or more isomorphic characteristics. An exemplary isomorphic characteristic comprises controlling the pattern formation so as to maintain generally uniform surface area of the foil surface members 22 associated with predefined regions of the hair-receiving section 14. For example, if a prescribed area is defined within a subset of the corresponding amorphous arrangement of apertures 24 so as to encompass a statistically significant number of hair-entrance apertures 20, the total foil area of the foil surface members 22 within that prescribed area would be substantially the same as a similarly prescribed foil area in a different location of the hair-receiving section 14 of the foil 10. In this regard, the isomorphic characteristic may be defined in one dimension, e.g., across the width of the hair-receiving section 14 of the foil 10, or in multiple directions.

With reference back to FIG. 2, as an example, the combined foil area of the foil surface members 22 within a first portion 28A of the hair-receiving section 14 is generally similar to the combined foil area of the foil surface members 22 within a second portion 28B of the hair-receiving section 14. Expressed in a slightly different manner, an aperture ratio of the first portion 28A is generally the same as an aperture ratio of the second portion 28B, where the aperture ratio is defined as the ratio of the area of all of the hair-entrance apertures 20 within a given portion to the total area of that portion. Such an isomorphic characteristic may be beneficial, e.g., to prevent uneven or inconsistent deflection of the foil 10 in different areas of the hair-receiving section 14 to a degree that adversely affects the quality of a shaving operation. An example of how to control the foil area will be discussed in greater detail herein.

Other isomorphic characteristics that may be of interest may include the total surface area removed from the foil 10 due to the hair-entrance apertures 20, number of hair-entrance apertures 20, distributions of particular polygon geometries that define the shapes of the hair-entrance apertures 20, etc.

Constraints

Depending upon the application, it may be desirable to constrain one or more parameters that define the hair-entrance apertures 20 in the hair-receiving section 14 of the foil 10 including their size, shape, orientation and/or spacing between adjacent aperture centers. Where the hair-entrance apertures 20 are polygonal in shape, aperture parameters including the number of sides, angles and area can each be controlled within predetermined designed-for ranges and still maintain an overall random characteristic.

The size of each hair-entrance aperture 20 will likely be bounded to some reasonable range of sizes. Hair-entrance apertures 20 that are too small to capture a hair are likely undesirable for shaving applications. Likewise, if the maximum size of a given hair-entrance aperture 20 is too large, then skin may press through that hair-entrance aperture 20 causing undesirable shaving performance. Also, a large distribution or improper weighting of sizes of the hair-entrance apertures 20 may undesirably impact the properties of a given shaving foil 10. For example, smaller sized hair-entrance apertures 20 are less effective at capturing relatively long, coarse hairs.

Practical considerations such as strength, rigidity and flexibility of the foil substrate may limit the minimum realizable width W of the corresponding foil surface members 22 between adjacent hair-entrance apertures 20 so as to not compromise the foil structure. That is, the foil 10 must be flexible to accommodate the surface to be shaved. However, uneven deflection across the hair-receiving section 14 of the foil 10 may adversely affect the quality of shaving. One approach to address such uneven deflection is to maintain a generally consistent area of the foil surface members 22 within predetermined areas of the foil as noted in greater detail herein.

By limiting the number of sides of the polygons defining the hair-entrance apertures 20 to a practical finite number, it becomes easier to establish an interlocking relationship between adjacent hair-entrance apertures 20. In this regard, the practical limit to the number of sides of each polygon can vary widely and may depend upon whether the amorphous arrangement of apertures 24 is to be defined manually, of through a computer implemented process.

An interlocking relationship between adjacent hair-entrance apertures 20 refers generally where a first hair-entrance aperture 20 includes a straight side edge that corresponds with, e.g., aligns substantially in parallel with, an associated straight side edge of an adjacent hair-entrance aperture 20. Such an arrangement allows uniform spacing, e.g., via the width W of associated foil surface members 22, between adjacent hair-entrance apertures 20. An interlocking relationship between adjacent hair-entrance apertures 20 makes it easier for the designer to maintain a generally consistent foil surface area within predetermined portions of the hair-receiving section 14 of the foil 10.

Likewise, too great a maximum realizable spacing between adjacent hair-entrance apertures may affect the overall performance of the shaving system, e.g., by requiring a relatively greater amount of time for an operator to navigate the hair-entrance apertures 20 in the foil 10 over the surface to be shaved. In this regard, the random characteristics of the amorphous hair-entrance apertures 20 may be statistically controlled by some predetermined measure. By limiting the aperture shape to polygons having a practical finite number of sides as noted in greater detail herein, e.g., so as to not be curvilinear, an interlocking pattern of hair-entrance apertures 20 can be arranged, at least theoretically, so that the foil area between adjacent hair-entrance apertures 20 can range from 0% to 100% of the area of the hair-receiving section 14 of the foil 10.

Practical limits on the number of hair-entrance apertures 20, the size range of the hair-entrance apertures 20 and the foil surface area between adjacent hair-entrance apertures 20 will set realistic constraints based for example, upon the size of the particular foil 10, the strength and/or flexibility of the foil substrate and the thickness of the foil 10. Moreover, from a practical standpoint, the ability to control the spacing between adjacent hair-entrance apertures 20 allows the foil area within the hair-receiving section 14 to be appropriately established as needed by a particular designed-for shaving application.

Methodology

Any suitable method, including manual approaches, may be utilized to design the hair-receiving section 14 of the foil 10, e.g., in terms of desirable aperture size, shape, spacing, orientation, etc. However, where the number of imposed constraints, or other design parameters so warrant, a computer can be used to design the hair-receiving section 14 of the foil 10.

Figure 6:
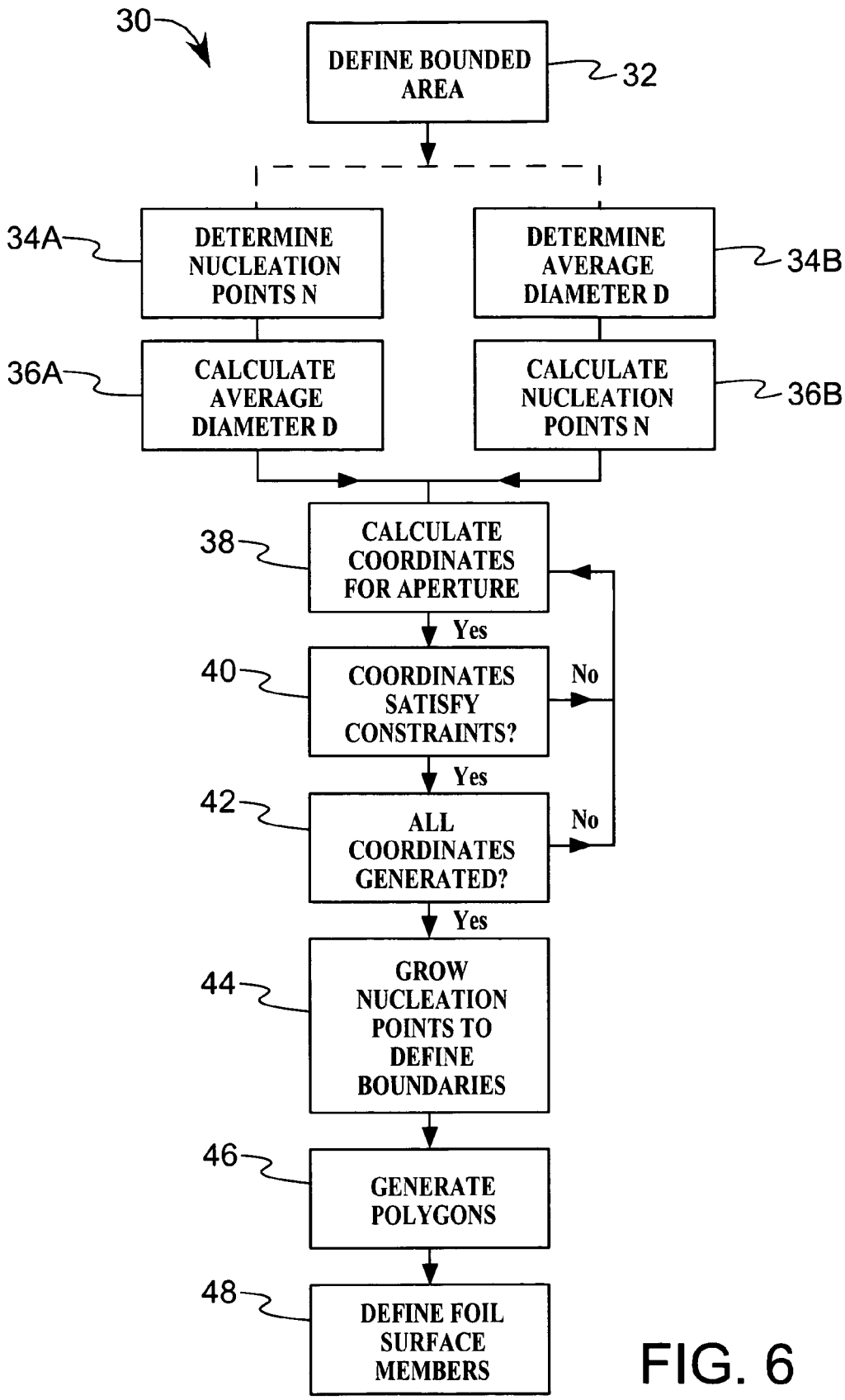
FIG. 6 is a flow chart illustrating a method of generating an amorphous arrangement of apertures.

One exemplary method of systematically generating an amorphous arrangement of apertures 24 utilizes a constrained Voronoi tessellation of 2-space. This method not only systematically generates the amorphous arrangement of apertures 24, but it also permits the tailoring of desirable aperture size, shape, orientation and spacing with respect to the foil 10. With reference to FIG. 6, the method 30 defines a bounded amorphous area at 32. Such a bounded amorphous area may be defined by relative coordinates that characterize the size of the hair-receiving section 14 of the foil 10 or a subset thereof, e.g., where the hair-receiving section will further include one or more non-amorphous patterns or amorphous regions with different constraints. For sake of discussion herein, the coordinates will be discussed in Cartesian coordinate form that extend in a rectangular plane from 0,0 to $X_{MAX}$, $Y_{MAX}$. However, different coordinate systems may be used.

A number of nucleation points N are determined at 34A. The number of nucleation points corresponds to the number of polygonal hair-entrance apertures 20 desired in the amorphous area. The number of nucleation points N thus comprises an integer, and may be selected with regard to the average size and spacing of the polygonal hair-entrance apertures 20 desired in the amorphous area. One exemplary approach for determining an approximate number of nucleation points is to select a hypothetical polygon of arbitrary size and shape, e.g., an average size and average shape, and, to compute the number of uniform instances of the hypothetical polygon that is required to fill the amorphous area.

A larger value of N corresponds to relatively smaller polygonal shaped apertures, and a smaller value of N corresponds to relatively larger polygonal shaped apertures. As an alternative to selecting the number of nucleation points N, a desired average diameter D of the apertures may be selected at 34B. If a choice is made to determine the number of nucleation points N at 34A, then the average diameter D is computed at 36A. Similarly, if a choice is made to determine the average diameter D at 34B, then the number of nucleation points N is calculated at 36B.

Based upon the number of nucleation points N, a series of coordinates are generated at 38 that map to the amorphous area to be filled with hair-entrance apertures. For example, when implementing constrained Voronoi tessellation of 2-space on a computer, a random number generator can be used to generate a series of random numbers that represent coordinates in the amorphous area. In the above example of mapping to a Cartesian coordinate system, two random numbers are generated for each nucleation point, one number corresponding to the X coordinate, and one number corresponding to the Y coordinate. The random number generator may generate normalized numbers or numbers in ranges that must be suitably scaled to map the coordinate space of the amorphous area. For example, many computer executed random number generators accept as an input, a seed value, which is converted into a random or pseudorandom number that is normalized between the values of 0 and 1. If such a value if provided, the normalized random number can be appropriately scaled within the range of 0,0 to $X_{MAX}$, $Y_{MAX}$. Also, it may be desirable to store the generated pairs of (X,Y) coordinates for future reference.

In order to provide control over the degree of randomness associated with the generation of the nucleation point coordinates, a constraint may be imposed on the generation or selection of the random numbers that define the nucleation point coordinates in the amorphous area. One exemplary constraint, designated herein as β, limits the proximity of neighboring nucleation point locations through the introduction of an exclusion distance, E, which represents the minimum distance between any two adjacent nucleation points. The exclusion distance E is computed as follows:

$$E = \frac{2\beta}{\sqrt{\lambda\pi}}$$

In the above equation, λ defines the density of points, e.g., points per unit area and β is expressed as a value in the range from 0 to 1. If β=0, then the exclusion distance E is zero, and the nucleation point coordinates will be generally random, or at least pseudorandom. If β=1, the exclusion distance E is equal to the nearest neighbor distance for a hexagonally close-packed array. Thus, selecting β between 0 and 1 allows control over the "degree of randomness" between these two extremes. Once the constraint β is computed, each coordinate pair generated by the random number is compared against all previous other coordinate pairs based upon the computed exclusion distance. The currently considered coordinate pair is discarded if it falls within the exclusion distance of any one of the previously generated coordinate pairs.

By constraining the proximity of neighboring nucleation point locations through the introduction of an exclusion distance, the variation in center-to-center spacing of apertures is controlled, which will translate into a corresponding degree of variation in number of sides in the resulting polygons as well as polygon size. A less constrained set of nucleation point coordinates will exhibit a broader range of polygon sizes and shapes than a more constrained set of nucleation point addresses.

Additional constraints may also be imposed as the specific application dictates. Thus, the coordinates generated at 38 are checked against imposed constraints, if any, at 40. If the generated coordinates fail to pass the requirements of the associated constraints, a new set of coordinates is generated at 38. If the coordinates are accepted, a check is performed to determine whether N coordinate pairs have been generated, corresponding to a coordinate pair for each nucleation point at 42. If less than N coordinate pairs have been generated, the process loops back to generate a new pair of coordinates at 38.

Once the nucleation point coordinates have been computed, from at least a conceptual standpoint, a circle is grown for each nucleation point at 44. Each circle grows radially outward from its associated nucleation point, e.g., simultaneously and at the same rate. As the perimeters of neighboring circles meet, growth for those circles stops, thus defining a boundary line. These boundary lines each form the edge of a polygon, with vertices formed by intersections of boundary lines.

Delaunay triangulation is one exemplary technique for conceptually growing the circles about the nucleation points. Using Delaunay triangulation, each nucleation point is assigned a unique identifier for identification purposes, and combinations of three nucleation points are assembled and tracked, e.g., by storing the combinations and their corresponding nucleation point identifiers.

The radius and center point coordinates are calculated for a circle passing through each set of three triangularly-arranged nucleation points. The coordinate locations of each remaining nucleation point, i.e., each nucleation point not used to define the particular triangle, are compared with the coordinates of the circle (radius and center point) to determine whether any of the other nucleation points fall within the circle of the three points of interest. If no other nucleation points fall within the circle, then the three nucleation point identifiers, their X and Y coordinates, the radius of the circle, and the X and Y coordinates of the circle center are stored. If a nucleation point not used to construct the triangle falls within the circle, no results are saved and the calculation progresses to the next set of three points.

Next, a polygon corresponding to each nucleation point is determined at 46. For example, once the Delaunay triangulation has been completed, a Voronoi tessellation of 2-space is performed to generate the polygons. Each nucleation point saved as being a vertex of a Delaunay triangle defines the center of a polygon. The outline of the polygon is generated by sequentially connecting the center points of the circumscribed circles of each of the Delaunay triangles, which include that vertex, sequentially in clockwise fashion. In generating the polygons, a comparison is made such that any triangle vertices at the boundaries of the area may be omitted from the calculation since they will not define a complete polygon. Upon completion of the tessellation, each vertex of a polygonal shaped aperture can be saved as a coordinate in a data file.

Once an amorphous aperture arrangement is generated, the width of the foil surface members 22 between the polygons can be added at 48. Foil surface member 22 can be added by thickening the boundary lines that form the edges of the polygonal shaped apertures. For example, to increase the width of foil surface members 22 between polygons, a computer program, routine or algorithm can be written to add one or more parallel lines to each side edge of adjacent polygons to increase the width W of the corresponding foil surface member width, and correspondingly decrease the area of the associated polygon.

The above technique for defining surface members 22 by thickening the boundary lines of the hair-entrance apertures 20 allows control over certain predetermined constraints if imposed, such as maintaining the minimum width W of the foil surface members 22, or maintaining a generally consistent foil area across the amorphous arrangement of apertures, e.g., to prevent uneven or inconsistent deflection of the foil 10 in different areas of the hair-receiving section 14 to a degree that adversely affects the quality of a shaving operation. Additionally, the designer can customize any individual aperture or set of apertures for size, shape, orientation, or spacing. Other examples of implementing the generation of amorphous arrangements are defined in U.S. Pat. No. 5,965,235 to McGuire et al.

A photographic negative can be made from the generated amorphous arrangement or assembly of differing amorphous arrangements. This negative may be utilized as the input for a conventional etching process during manufacturing of the foil 10. Any number of alternative techniques may also be used to manufacture the foil 10 based upon the generated amorphous arrangement(s).

Exemplary Approaches for Identifying Amorphous Arrangements

As noted in greater detail herein, the hair-receiving section 14 of the foil 10 may include at least one amorphous arrangement of apertures 24, and optionally, a non-amorphous pattern of apertures. In this regard, the amorphous arrangement of apertures 24 appears disordered, whereas the non-amorphous pattern, if present will appear to exhibit some order.

The order of a non-amorphous pattern may be characterized in a number of different ways. For example, an ordered pattern may repeat in one or more directions. Moreover, the ordered pattern may be periodic, i.e., where the ordered pattern includes a subset that is repeated in a regular way throughout the ordered pattern.

The ordered pattern may also be quasi-periodic. An ordered pattern is quasi-periodic if a copy of a subset of that pattern can be moved about the pattern so as to align with a different subset of the pattern. However, if an exact copy of the entire ordered pattern were shifted over the original pattern, then various subsets can be matched up locally, but the original pattern and the copy pattern, as a whole, will not match up. A well-known example of a quasi-periodic pattern comprises a Penrose tiled patterns.

Still further, an ordered pattern may be symmetric. An ordered pattern is symmetric if a copy of a subset of the pattern can be moved to a different location within the pattern such that the copy exactly matches up with the pattern. In this regard, symmetry may be achieved via a rotation of the copy of the subset relative to the pattern, a translation or movement of the copy of the subset relative to the pattern, a reflection of the copy of the subset, e.g., a mirror image of the subset, relative to the pattern, or a combination of the above.

At least two exemplary functions can be analyzed to determine whether an arrangement of hair-entrance apertures 20 within the hair-receiving section 14 of the foil 10 is amorphous. The distribution of areas of the hair-entrance apertures 20 within the arrangement may be analyzed. Also, the point-to-point distances of the hair-entrance apertures 20, e.g., as measured from a first aperture center to a second aperture center, may be analyzed.

Area Distributions

Figure 7:
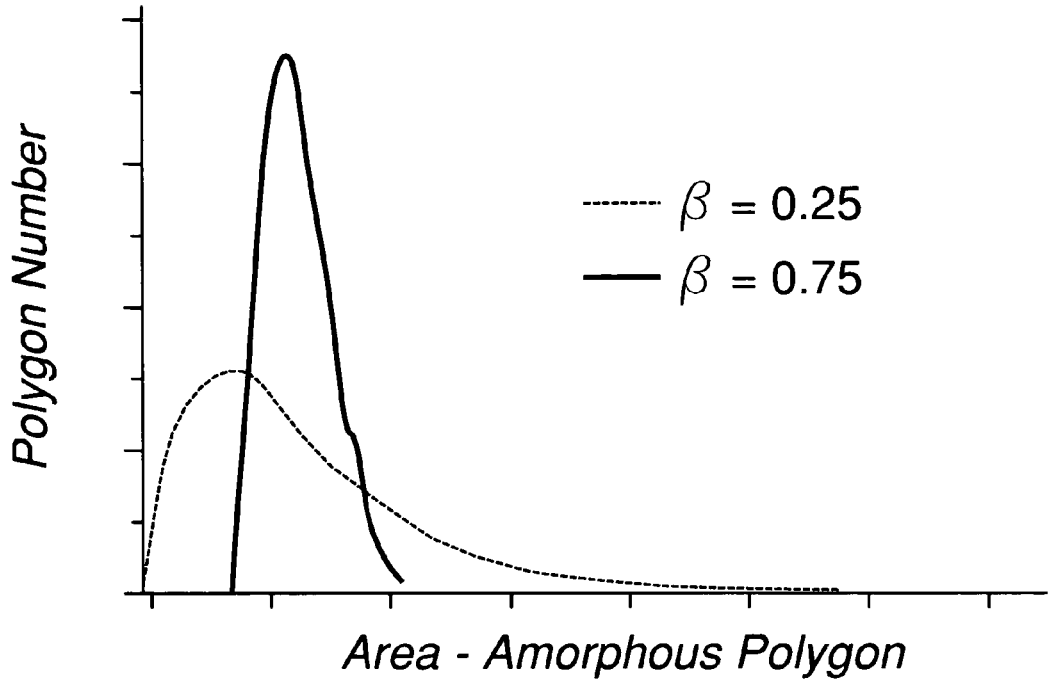
FIG. 7 is an exemplary area distribution plot illustrating a generally continuous distribution of areas of hair-entrance apertures.
Figure 8:
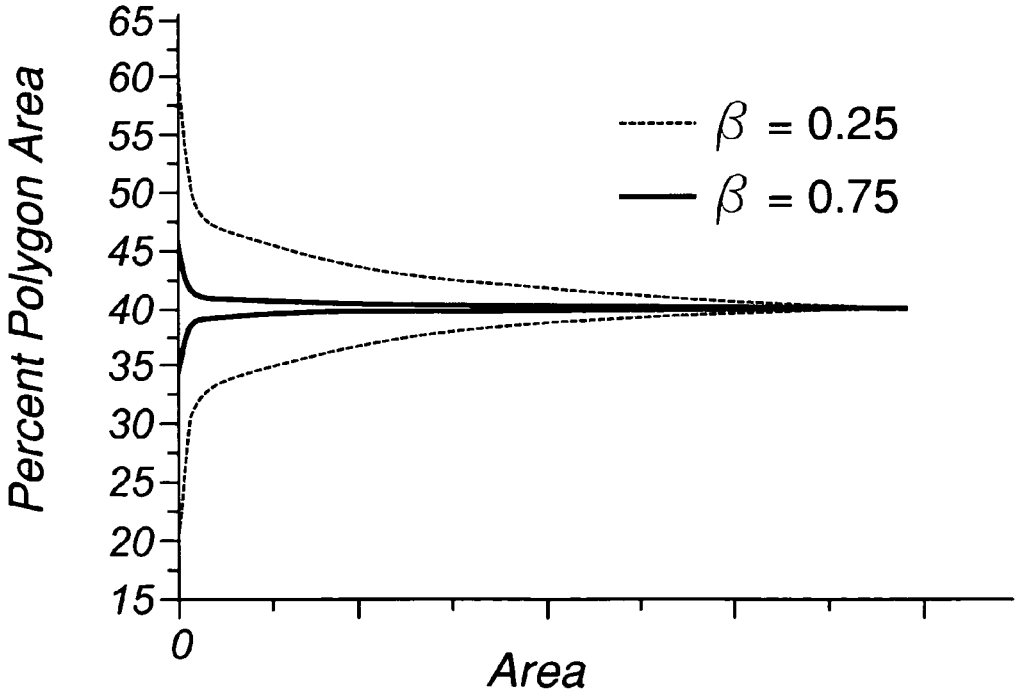
FIG. 8 is an exemplary graph that depicts upper and lower limits of polygon area for a sample area.

With reference to FIG. 7, an exemplary area distribution plot is illustrated. An amorphous arrangement will generally reveal a continuous distribution of areas within a reasonable sample area of the hair-receiving section 14 of the foil 10. The size of the reasonable sample area will vary depending upon the size or size range of hair-entrance apertures 20. With reference to FIG. 8, a graph depicts a similar comparison to that of FIG. 7. However, the graph of FIG. 8 depicts the upper and lower limits (in percentage) of polygon area for an exemplary sample area.

Figure 9:
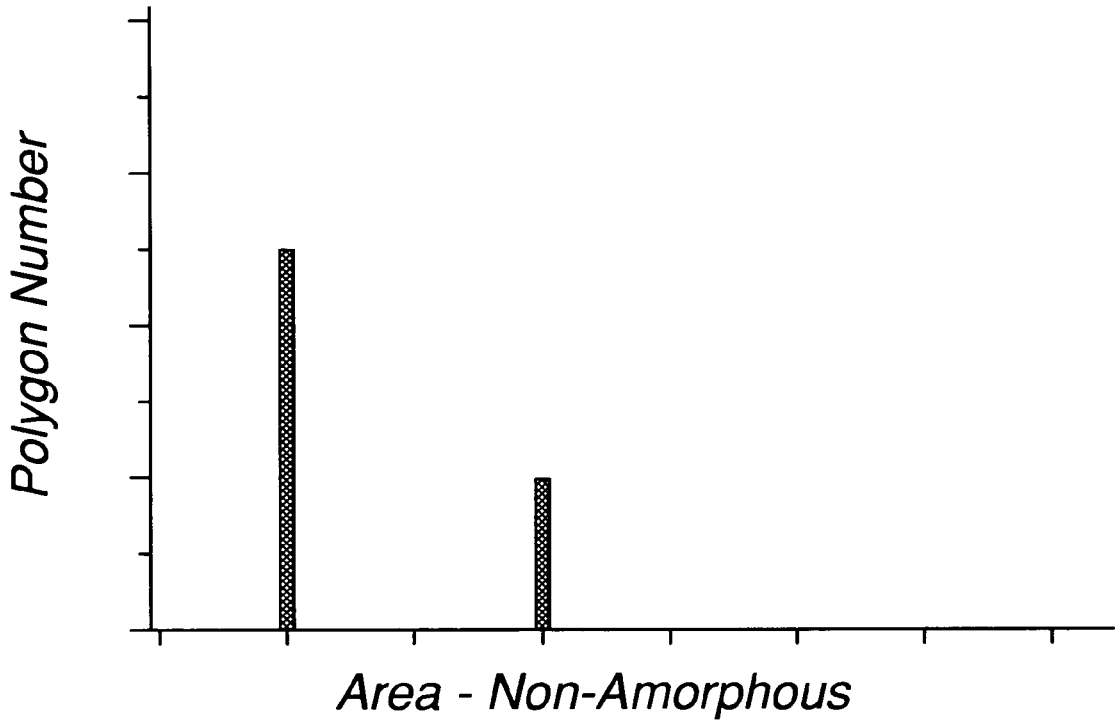
FIG. 9 is an exemplary area distribution plot illustrating a non-continuous distribution of areas of hair-entrance apertures.

For periodic patterns, e.g., patterns that repeat in a regular way, and for a periodic patterns, e.g., a Penrose tiling, the area distribution plot will consist of only a small number of distinct areas and will thus not represent a continuous distribution as illustrated in FIG. 9. For example, the apertures in the Penrose tiling are all fixed geometric shapes of limited number, e.g. two to four shapes. As such, the distribution illustrated in FIG. 9 includes sharp discontinuities compared to the corresponding generally continuous arrangement of FIG. 7. Thus, the exemplary arrangement of apertures graphed in FIG. 7 is considered an amorphous arrangement of apertures and the exemplary arrangement of apertures graphed in FIG. 9 is considered a non-amorphous pattern of apertures.

Distance Distributions

If each hair-entrance aperture 20 is assigned a center point, e.g., the center of mass of the hair-entrance aperture 20, an analysis can determine whether such center points are substantially randomly distributed. The benchmark for complete randomness is the Poisson process. In a Poisson process, the center points are randomly distributed and the distance from any center point to any other center point can be expressed by Ripley's K function:

$$K(t)=\lambda\pi t^2$$

Ripley's K function states that the number of points (K) within a distance (t) from the point in question is proportional to the square of the distance. That is, if the density of points in an area of interest is known, which is the case for the present invention, then a circle of radius t and area $\pi t^2$ will contain K points. A separate function, L(t) can then be defined as:

$$L(t)=\sqrt{K(t)/\lambda\pi}$$

wherein λ, as defined above, is the number of points per unit area.

For a Poisson (random) process, since $K(t)\propto t^2$, a plot of L against t would give a straight line with a slope of 1.

Figure 10:
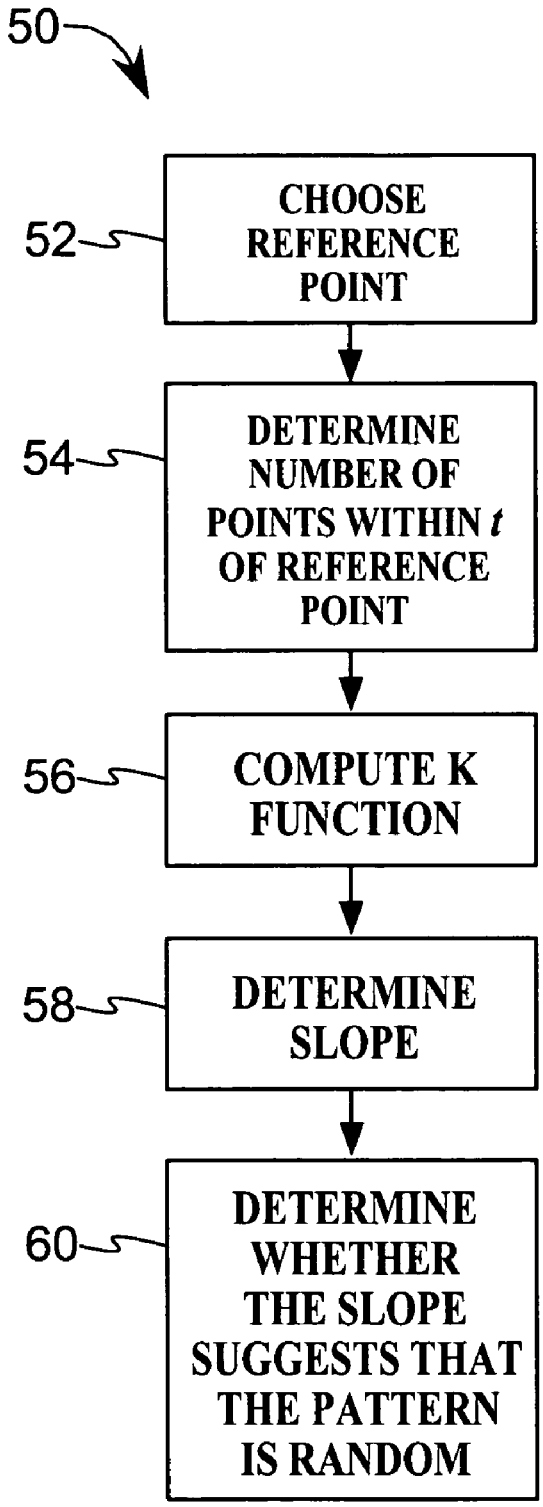
FIG. 10 is a flow chart illustrating one exemplary approach to determining whether an arrangement of hair-entrance apertures is generally amorphous.

With reference to FIG. 10, to determine if the center points of the hair-entrance apertures 20 are randomly distributed within a predetermined sample area of interest, a method 50 comprises generating a plot of L against t. To create the plot, a point is chosen as the reference point at 52. The number of points within a distance t of the reference point is determined at 54. The above process may be repeated for all values of t (encompassing all of the other points). A K function is calculated at 56. From the results, a slope is computed at 58, e.g., by generating a plot, and randomness is determined at 60.

Figure 11:
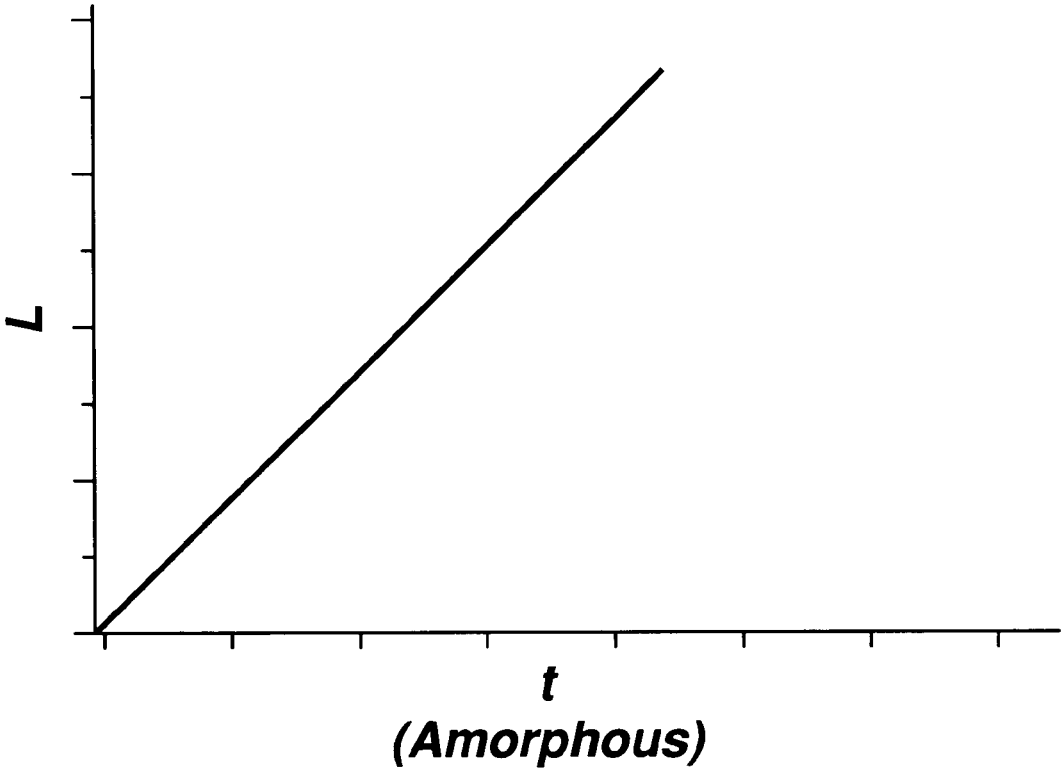
FIG. 11 is an exemplary plot illustrating a random distribution of aperture center spacing.

Plots that are generally continuous and straight within reasonable tolerances indicate that the corresponding distribution of centers of the hair-entrance apertures 20 is random, thus the apertures are in an amorphous arrangement as illustrated by the plot in FIG. 11. That is, arbitrarily small changes in the X direction value on the plot produces arbitrarily small changes in the Y direction value on the plot, e.g., within predetermined confidence intervals.

Figure 12:
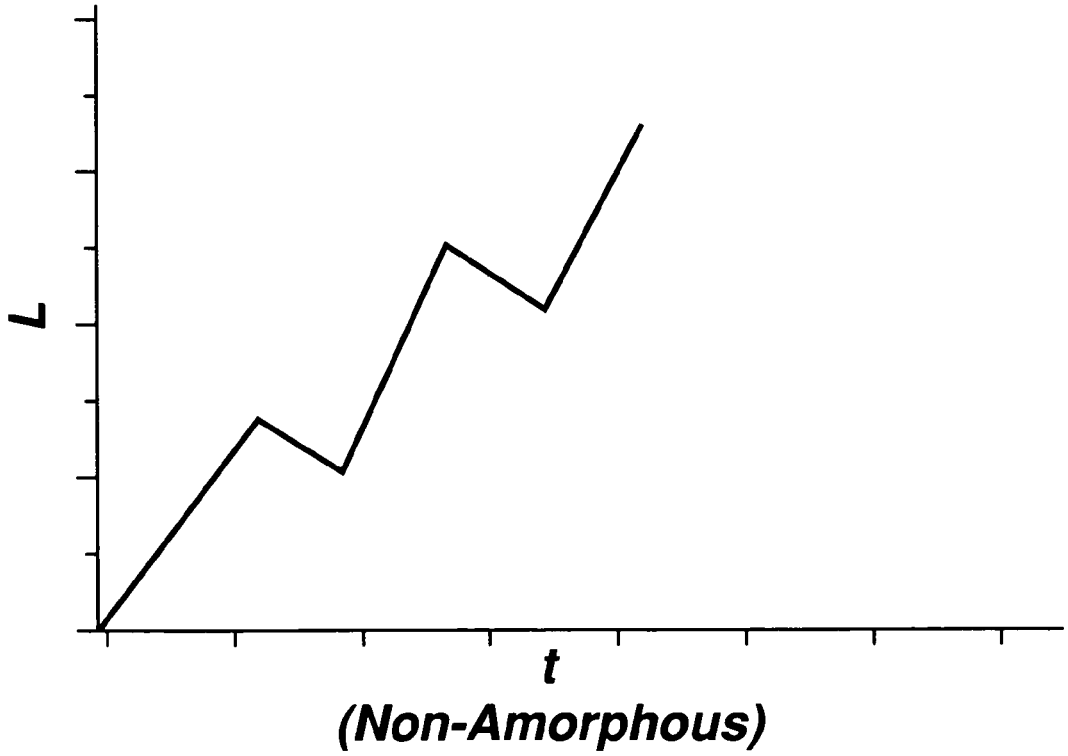
FIG. 12 is an exemplary plot illustrating a nonrandom distribution of aperture center spacing.

Moreover, curve-fitted plots that have a line with discontinuities or abrupt undefined values indicates that the distribution of centers of the hair-entrance apertures 20 is not random and the apertures are considered in a non-amorphous pattern as illustrated by the plot in FIG. 12. For example, in a Penrose tiled pattern of apertures, or in a periodic pattern of apertures, the plot will have portions where an arbitrarily small change in the X direction of the plot will result in a relatively large or broken jump in the value on the Y direction of the plot, or the Y direction value may be undefined at points along the plot, and thus such patterns of apertures are not amorphous.

By way of example, a statistically significant selected subset of hair-entrance apertures 20 with regard to the entire amorphous arrangement should yield statistically substantially equivalent values for such properties as the number of apertures, the average area of the apertures, the average size of the apertures, the average spacing between apertures, etc. Such a correlation may be desirable with respect to physical foil properties because the uniform statistical properties should tend to also suggest uniform properties across the foil 10. For example, the apertures may be provided such that a statistically equivalent number of apertures are realized per unit of measure by a line drawn in any given direction outwardly as a ray from a given point, so long as the unit of measure is selected so as to be at least big enough to derive a statistically significant number of apertures.

The shaver foils of the present invention can be used for a wide variety of shaving purposes including but not limited to men's and women's shaving (e.g., face, whiskers, underarms, other body hair including arms, legs, head, back of the neck, and bikini shaving, etc.), shaving of pets and animals, removal of frayed threads and pilling of fabrics and webs, and other purposes as may be known or apparent now or in the future.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving foil for a shaving system comprising:

a foil support section for support of said foil over a cutting member of said shaving system; and a hair-receiving section having:

a plurality of hair-entrance apertures that define at least one amorphous arrangement of apertures that extends across the entirety of said hair-receiving section of said foil; and a plurality of foil surface members that form a network of surface area adjacent to said plurality of hair-entrance apertures wherein each aperture is a different shape.

2. The shaving foil according to claim 1, wherein:

the different shaped apertures are polygonal shaped; and said foil surface members comprise a width defined as distance between a point on a first edge of a first hair-entrance aperture and a proximal point on a corresponding edge of a second hair-entrance aperture which is adjacent to said first hair-entrance aperture, wherein:

said foil surface members further comprising lengths that remains substantially uniform across a distance that said first edge of said first hair-entrance aperture and said corresponding edge of said second hair-entrance aperture remain substantially parallel.

3. The shaving foil according to claim 1, wherein said foil surface members are so configured such that a combined area of foil surface members within a first designated portion of said hair-receiving section is generally similar to a combined area of foil surface members within a second designated portion of said hair-receiving section where the first and second designated portions are similar in total area of said foil and located at different positions.

4. The shaving foil according to claim 1, wherein said hair-entrance apertures within said amorphous arrangement of apertures are configured such that there is no readily discernable or perceptible pattern to the orientation and size of said shaped apertures within at least one predetermined constraint.

5. The shaving foil according to claim 1, wherein said hair-entrance apertures within said amorphous arrangement of apertures are configured such an orientation of a first one of said different shaped apertures with regard to a neighboring one of said different shaped apertures bears no predictable relationship to that of succeeding different shaped apertures.

6. The shaving foil according to claim 1, wherein said at least one amorphous arrangement of apertures comprises a first amorphous arrangement of apertures within a first portion of said hair-receiving section of said foil, and a second arrangement of apertures in a second portion of said hair-receiving section of said foil, said second arrangement of apertures comprising one of a non-amorphous arrangement of apertures or a second amorphous arrangement of apertures having at least one different constraint than said first amorphous arrangement of apertures.

7. The shaving foil according to claim 1, wherein said hair-entrance apertures within said amorphous arrangement of apertures are arranged such that a distribution of at least one of hair-entrance size, and center to center spacing between adjacent hair-entrance apertures is substantially continuous within said at least one amorphous arrangement of apertures.

8. The shaving foil according to claim 1, wherein said hair-entrance apertures within said amorphous arrangement of apertures include at least one of an area of each hair-entrance aperture in said amorphous arrangement of apertures and a center-to-center spacing of each hair-entrance aperture in said amorphous arrangement of apertures is generally randomly distributed.

9. The shaving foil according to claim 1, wherein said hair-entrance apertures within said amorphous arrangement of apertures include a center-to-center spacing of each hair-entrance aperture in said amorphous arrangement of apertures is generally randomly distributed, wherein a plot of L versus t results in a line having a substantially straight line with a slope of substantially one, wherein:

each hair-entrance aperture is assigned a center point;

a first center point is designated a reference point;

t defines a distance from a current center point to said reference center point;

K defines as a number of points within a distance, t $\lambda$ defines as the number of points per unit area $K(t)=\lambda\pi^2$, and $L(t)=\sqrt{\{\text{square root over } (K(t)/\lambda\pi)\}}$.

10. A shaving system comprising:

a housing; and a cutting head at a first end of said housing, said cutting head having:

a cutting member extending from said housing;

a foil frame mated with said housing; and a foil supported by said foil frame so as to be oriented generally over said cutting member, said foil having a hair-receiving section comprised of a plurality of hair-entrance apertures that define at least one amorphous arrangement of apertures each having a different shape and a plurality of foil surface members, wherein:

each hair-entrance aperture is at least partially surrounded by associated foil surface members that are interconnected in a network of surface area.

11. The shaving system according to claim 10, wherein said hair-entrance apertures within said amorphous arrangement of apertures are configured such that there is no readily discernable or perceptible pattern to the orientation and size of said different shaped apertures within at least one predetermined constraint.

12. The shaving system according to claim 10, wherein said hair-entrance apertures within said amorphous arrangement of apertures are configured such an orientation of a first one of said different shaped apertures with regard to a neighboring one of said different shaped apertures bears no predictable relationship to that of succeeding different shaped apertures.

13. The shaving system according to claim 10, wherein said hair-entrance apertures within said amorphous arrangement of apertures comprise are configured so as to exhibit no readily discernable organization and regularity of said hair-entrance apertures.

14. The shaving system according to claim 10, wherein said hair-entrance apertures within said amorphous arrangement of apertures include at least one of an area of each hair-entrance aperture in said amorphous arrangement of apertures and a center-to-center spacing of each hair-entrance aperture in said amorphous arrangement of apertures is generally randomly distributed.

15. The shaving system according to claim 10, wherein said hair-entrance apertures within said amorphous arrangement of apertures include a center-to-center spacing of each hair-entrance aperture in said amorphous arrangement of apertures is generally randomly distributed, wherein a plot of L versus t results in a line having a substantially straight line with a slope of substantially one, wherein:

each hair-entrance aperture is assigned a center point;

a first center point is designated a reference point;

t defines a distance from a current center point to said reference center point;

K defines as a number of points within a distance, t $\lambda$ defines as the number of points per unit area $K(t)=\lambda\lambda^2$, and $L(t)=\sqrt{\{\text{square root over } (K(t)/\lambda\pi)\}}$.

16. The shaving foil according to claim 1, wherein said hair-entrance apertures within said amorphous arrangement of apertures have a random orientation.

17. The shaving foil according to claim 16, wherein said hair-entrance apertures within said amorphous arrangement of apertures have a random size.

18. The shaving foil according to claim 1, wherein said hair-entrance apertures within said amorphous arrangement of apertures have a random size.

19. The shaving system according to claim 10, wherein said hair-entrance apertures within said amorphous arrangement of apertures have a random orientation.

20. The shaving system according to claim 19, wherein said hair-entrance apertures within said amorphous arrangement of apertures have a random size.

21. The shaving system according to claim 10, wherein said hair-entrance apertures within said amorphous arrangement of apertures have a random size.

* * * * *